US010709304B2

(12) United States Patent
Stramka

(10) Patent No.: US 10,709,304 B2
(45) Date of Patent: Jul. 14, 2020

(54) UNIVERSAL HOSE ASSEMBLY FOR WET/DRY VACUUMS

(71) Applicant: Thomas Stramka, Brooklyn, NY (US)

(72) Inventor: Thomas Stramka, Brooklyn, NY (US)

( * ) Notice: Subject to any disclaimer, the term of this patent is extended or adjusted under 35 U.S.C. 154(b) by 35 days.

(21) Appl. No.: 16/216,422

(22) Filed: Dec. 11, 2018

(65) Prior Publication Data

US 2019/0174980 A1 Jun. 13, 2019

Related U.S. Application Data

(60) Provisional application No. 62/597,080, filed on Dec. 11, 2017.

(51) Int. Cl.

| | |
|---|---|
| ***A47L 7/00*** | (2006.01) |
| ***A47L 9/24*** | (2006.01) |
| ***A47L 9/00*** | (2006.01) |
| *A47L 5/22* | (2006.01) |

(52) U.S. Cl.

CPC ..... *A47L 7/0009* (2013.01); *A47L 7/0019* (2013.01); *A47L 9/0027* (2013.01); *A47L 9/0036* (2013.01); *A47L 9/242* (2013.01); *A47L 9/248* (2013.01); *A47L 5/225* (2013.01)

(58) Field of Classification Search

CPC .... A47L 7/0009; A47L 7/0019; A47L 9/0027; A47L 9/0036; A47L 9/242; A47L 9/248; A47L 5/225

See application file for complete search history.

(56) References Cited

U.S. PATENT DOCUMENTS

| | | | | |
|---|---|---|---|---|
| 2005/0055794 | A1* | 3/2005 | Marshall | A47L 9/0027 15/353 |
| 2005/0081325 | A1* | 4/2005 | Park | A47L 9/242 15/353 |
| 2010/0213700 | A1* | 8/2010 | Stanek | A47L 9/242 285/7 |
| 2014/0366308 | A1* | 12/2014 | Bullock, Jr. | A47L 9/0027 15/323 |
| 2018/0235420 | A1* | 8/2018 | Stanek | A47L 9/0027 |
| 2019/0328188 | A1* | 10/2019 | Conrad | A47L 9/1608 |

* cited by examiner

*Primary Examiner* — Steven O Douglas

(57) ABSTRACT

A universal hose assembly for wet/dry vacuums is an apparatus having a belt that fastens around a shop vacuum and has a pivotal tube attached to the belt that an expandable vacuum hose is able to be retracted and stored within or expanded outward for use. The pivotal tube and expandable vacuum hose is pressed against the vacuum inlet via the belt and sealed with a gasket. The exterior side of the belt has accessory loops for holding various vacuum accessory attachments.

18 Claims, 5 Drawing Sheets

UNIVERSAL HOSE ASSEMBLY FOR WET/DRY VACUUMS

CROSS-REFERENCE TO RELATED APPLICATION

The present application is related to and claims priority from prior provisional application Ser. No. 62/597,080, filed Dec. 11, 2017 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of vacuum hoses and more specifically relates to a universal hose assembly for wet/dry vacuums.

2. Description of the Related Art

A vacuum cleaner, also known as a sweeper or hoover, is a device that uses an air pump (a centrifugal fan in all but some of the very oldest models), to create a partial vacuum to suck up dust and dirt, usually from floors, and from other surfaces such as upholstery and draperies. There are many different styles including upright, canister, stationary, portable, and shop or cylindrical styles. All vacuums have a suction hose attached to the inlet of the vacuum and usually various types of hose end attachments for cleaning different types of surfaces. Modern vacuums have a motor that powers the centrifugal fan and then the housing has an exhaust port for discharging the air as it circulates through the vacuum into the environment. The functional feature is the ability to collect the debris that is sucked up through the suction and then trapped in a canister that usually has a disposable collection bag located within. The air passes through the bag and then out the exhaust but the debris collected remains in the vacuum bag for disposal. Some cylindrical types are able to suction water as well as debris. These are called wet or dry vacuums.

A common inconvenience of nearly all vacuums except some upright styles is the suction hose usage and storage. The suction hoses tend to be inconveniently short because there is no convenient way to store them when the vacuum is not in use. Most vacuums wrap the suction hose around the vacuum or have clips to snap the hose into to hold it close to the vacuum during storage. With these storage methods, the hoses tend to be too short to suction anything that is not within 2½ feet of the vacuum. A separate hose of sufficient length must be acquired for the vacuum to reach longer distances or to reach higher locations such as high shelves or ceiling fans. The longer hoses must usually be stored separately to avoid clutter or the sprawling effect across walkways. A solution to address these common problems with vacuum hoses is needed.

Various attempts have been made to solve the above-mentioned problems such as those found in U.S. Pat. No. 7,895,708 to Proud et al; U.S. Pat. No. 5,797,162 to Vystrcil et al.; U.S. Pat. No. 5,778,939 to Timmy Sin Hok-Yin. This art is representative of vacuum hoses. None of the above inventions and patents, taken either singly or in combination, is seen to describe the invention as claimed.

Ideally, a vacuum hose should provide sufficient length during use and retract to a convenient storage length, and, yet would operate reliably and be manufactured at a modest expense. Thus, a need exists for a reliable universal hose assembly for wet/dry vacuums to avoid the above-mentioned problems.

BRIEF SUMMARY OF THE INVENTION

In view of the foregoing disadvantages inherent in the known vacuum hose art, the present invention provides a novel universal hose assembly for wet/dry vacuums. The general purpose of the present invention, which will be described subsequently in greater detail, is to provide sufficient length during use and retract to a convenient storage length.

The universal hose assembly for wet/dry vacuums preferably comprises a belt having at least one loop attached that is adapted to releasably hold accessories. The belt is adapted to adjustably attach around the outer wall of a wet/dry vacuum to hold an expanding hose having an elongated cylindrical wall including a proximal end, a distal end, and a length extending from the proximal end to the distal end. The elongated cylindrical wall forms a hollow interior volume and an attachment portion having a ring portion is adapted to connect with the ring portion of the wet/dry vacuum. A gasket ring is adapted to be placed in between the ring portion of the attachment portion of the expanding hose and the ring portion of the wet/dry vacuum to create a vacuum seal there between.

A connector portion rotatably connects to the ring portion and extends outwardly from it. The ring portion and the hose connector portion form a hollow cylindrical interior volume. The proximal end of the elongated cylindrical wall is pivotally connected to the connector portion of the attachment portion. An expandable hose member having a flexible cylindrical wall with a proximal end, a distal end, an exterior surface, and an interior surface is located within the elongated cylindrical wall. The flexible cylindrical wall forms a hollow interior volume and a helical wire is attached to the interior surface of the flexible cylindrical wall from the proximal end to the distal end such that the expandable hose member is adapted to contract into a shorter, contracted, configuration or be pulled into a plurality of expanded configurations to thereby adjust the length of the expandable hose member.

The expandable hose member is attached to the attachment portion and extends a substantial portion of the length of the elongated cylindrical wall when in the contracted configuration, and is adapted to extend a substantial length beyond the length of the elongated cylindrical wall when in a plurality of the expanded configurations.

The ring portion of the attachment portion of the expanding hose is releasably connected to the belt and the belt is adapted to releasably and adjustably hold the expanding hose to the ring portion of the wet/dry vacuum such that air leaving and entering the ring portion of the wet/dry vacuum passes through the expanding hose. The elongated cylindrical wall of the expanding hose further includes at least one aperture therethrough in proximity to the proximal end, and a flexible tab adjacent each aperture is adapted to releasably contact the exterior surface of the flexible cylindrical wall of the expandable hose member to thereby retain the expandable hose member in a chosen configuration.

The elongated cylindrical wall of the expanding hose further includes an attached clip adapted to releasably hold one of the elongated attachment tubes thereto. At least one elongated attachment tube is adapted to be releasably attached to the distal end of the flexible cylindrical wall of the expandable hose. The accessories include a plurality of elongated attachment tubes each adapted to be releasably attached to the distal end of the flexible cylindrical wall of the expandable hose. The plurality of elongated attachment tubes have differing lengths and differing shapes.

The expanding hose further includes a cap member adapted to releasably connect to and cover the distal end of the elongated cylindrical wall of the expanding hose when the expandable hose member is in the contracted configuration.

An improved wet/dry vacuum system may comprise a wet/dry vacuum having an outer wall with an aperture that allows air to pass through, a ring portion attached to the outer wall that surrounds the aperture, an inner volume, a motor located within the inner volume adapted to draw air into the aperture and force air out of the aperture, and a universal hose assembly comprising a belt having at least one attached loop adapted to releasably hold accessories.

The belt is adapted to adjustably attach around the outer wall of the wet/dry vacuum. An expanding hose is included that has an elongated cylindrical wall with a proximal end, a distal end, and a length extending from the proximal end to the distal end that forms a hollow interior volume. An attachment portion includes a ring portion adapted to connect with the ring portion of the wet/dry vacuum. A connector portion is rotatably connected to the ring portion and extends outwardly therefrom. The ring portion and the hose connector portion form a hollow cylindrical interior volume and the proximal end of the elongated cylindrical wall is pivotally connected to the connector portion of the attachment portion. An expandable hose member having a flexible cylindrical wall includes a proximal end, a distal end, an exterior surface, and an interior surface and the flexible cylindrical wall forms a hollow interior volume.

A helical wire is attached to the interior surface of the flexible cylindrical wall from the proximal end to the distal end such that the expandable hose member is adapted to contract into a contracted configuration, or be pulled into a plurality of expanded configurations and adjust to a length. The expandable hose member is attached to the attachment portion extending a substantial portion of the length of the elongated cylindrical wall when in the contracted configuration and is adapted to extend a substantial length beyond the length of the elongated cylindrical wall when in an expanded configuration.

The ring portion of the attachment portion of the expanding hose is releasably connected to the belt and the belt is adapted to releasably and adjustably hold the expanding hose to the ring portion of the wet/dry vacuum such that air leaving and entering the ring portion of the wet/dry vacuum passes through the expanding hose. The elongated cylindrical wall of the expanding hose further includes at least one aperture therethrough in proximity to the proximal end, and a flexible tab adjacent each aperture is adapted to releasably contact the exterior surface of the flexible cylindrical wall of the expandable hose member to thereby retain the expandable hose member in a chosen configuration.

At least one elongated attachment tube is adapted to be releasably attached to the distal end of the flexible cylindrical wall of the expandable hose. The elongated cylindrical wall of the expanding hose further includes an attached clip adapted to releasably hold one of the elongated attachment tubes. The accessories include a plurality of elongated attachment tubes each adapted to be releasably attached to the distal end of the flexible cylindrical wall of the expandable hose. The plurality of elongated attachment tubes are of different lengths and different shapes.

The expanding hose further includes a cap member adapted to releasably connect to and cover the distal end of the elongated cylindrical wall of the expanding hose when the expandable hose member is in the contracted configuration. A gasket ring is adapted to be placed in between the ring portion of the attachment portion of the expanding hose and the ring portion of the wet/dry vacuum to create a vacuum seal between the two.

The present invention holds significant improvements and serves as a universal hose assembly for wet/dry vacuums. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, a universal hose assembly for wet/dry vacuums, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a vacuum hose and more particularly to a universal hose assembly for wet/dry vacuums as used to provide sufficient length during use and retract to a convenient storage length.

Generally speaking, a universal hose assembly for wet/dry vacuums is an apparatus having a belt that fastens around a shop vacuum and has a pivotal tube attached to the belt that an expandable vacuum hose is able to be retracted and stored within or expanded outward for use. The pivotal tube and expandable vacuum hose is pressed against the vacuum inlet via the belt and sealed with a gasket. The exterior side of the belt has accessory loops for holding various vacuum accessory attachments.

Figure 1:
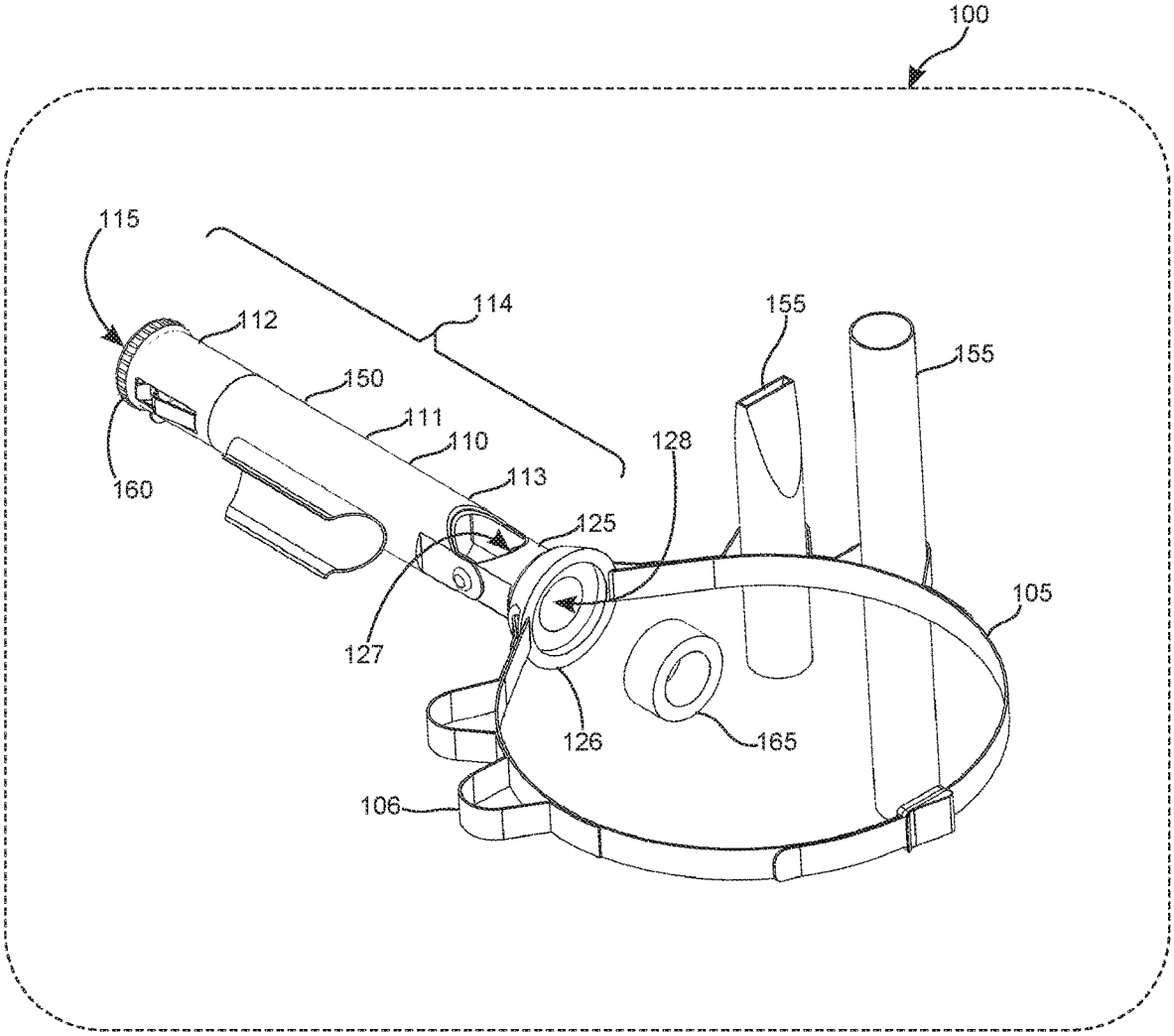
FIG. 1 shows a perspective view illustrating a universal hose assembly for wet/dry vacuums according to an embodiment of the present invention.

Referring to the drawings by numerals of reference there is shown in FIG. 1, a perspective view illustrating universal hose assembly for wet/dry vacuums 100 according to an embodiment of the present invention.

Universal hose assembly for wet/dry vacuums 100 preferably comprises belt 105 having at least one loop 106 attached that is adapted to releasably hold accessories 155. Belt 105 is adapted to adjustably attach around outer wall 206 of wet/dry vacuum 205 to hold expanding hose 110 having elongated cylindrical wall 111 including proximal end 112, distal end 113, and length 114 extending from proximal end 112 to distal end 113. Elongated cylindrical wall 111 forms a hollow interior volume 115 and attachment portion 125 having ring portion 126 is adapted to connect with ring portion 210 of wet/dry vacuum 205. Gasket ring 165 is adapted to be placed in between ring portion 126 of attachment portion 125 of expanding hose 110 and ring portion 210 of wet/dry vacuum 205 to create a vacuum seal there between.

Figure 2:
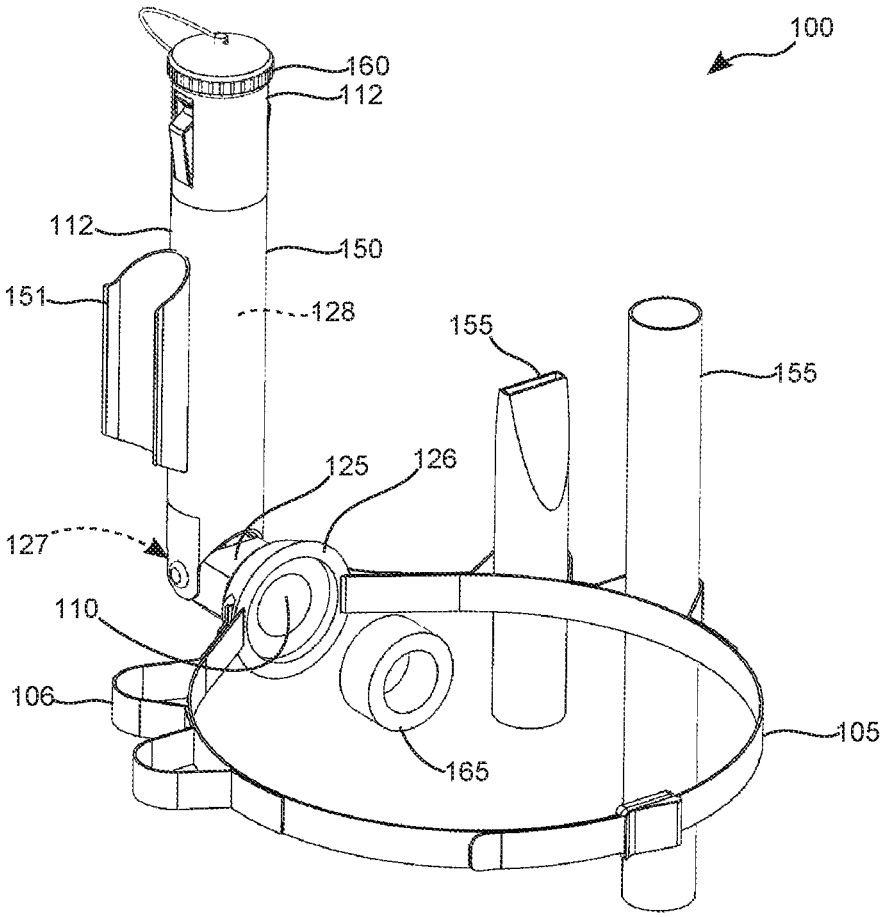
FIG. 2 is a perspective view illustrating a universal hose assembly for wet/dry vacuums with the attachment portion pivoted upward for storage according to an embodiment of the present invention of FIG. 1.

Referring now to FIG. 2, is a perspective view illustrating universal hose assembly for wet/dry vacuums 100 with attachment portion 125 pivoted upward for storage according to an embodiment of the present invention of FIG. 1.

Connector portion 127 rotatably connects to ring portion 126 and extends outwardly from it. Ring portion 126 and the hose connector portion 127 form hollow cylindrical interior volume 128. Proximal end 112 of elongated cylindrical wall 111 is pivotally connected to connector portion 127 of attachment portion 125. Ring portion 126 of attachment portion 125 of expanding hose 110 is releasably connected to belt 105 and belt 105 is adapted to releasably and adjustably hold expanding hose 110 to ring portion 210 of wet/dry vacuum 205 such that air leaving and entering ring portion 210 of wet/dry vacuum 205 passes through expanding hose 110.

Elongated cylindrical wall 111 of expanding hose 110 further includes an attached clip 151 adapted to releasably hold one of the elongated attachment tube 150 thereto. At least one elongated attachment tube 150 is adapted to be releasably attached to distal end 138 of flexible cylindrical wall 136 of expandable hose member 135. Accessories 155 include a plurality of elongated attachment tubes 156 each adapted to be releasably attached to t distal end 138 of flexible cylindrical wall 136 of expandable hose member 135. The plurality of elongated attachment tubes 150 have differing lengths and differing shapes.

Expanding hose 110 further includes cap member 160 adapted to releasably connect to and cover distal end 113 of elongated cylindrical wall 111 of expanding hose 110 when expandable hose member 135 is in the contracted configuration.

Figure 3:
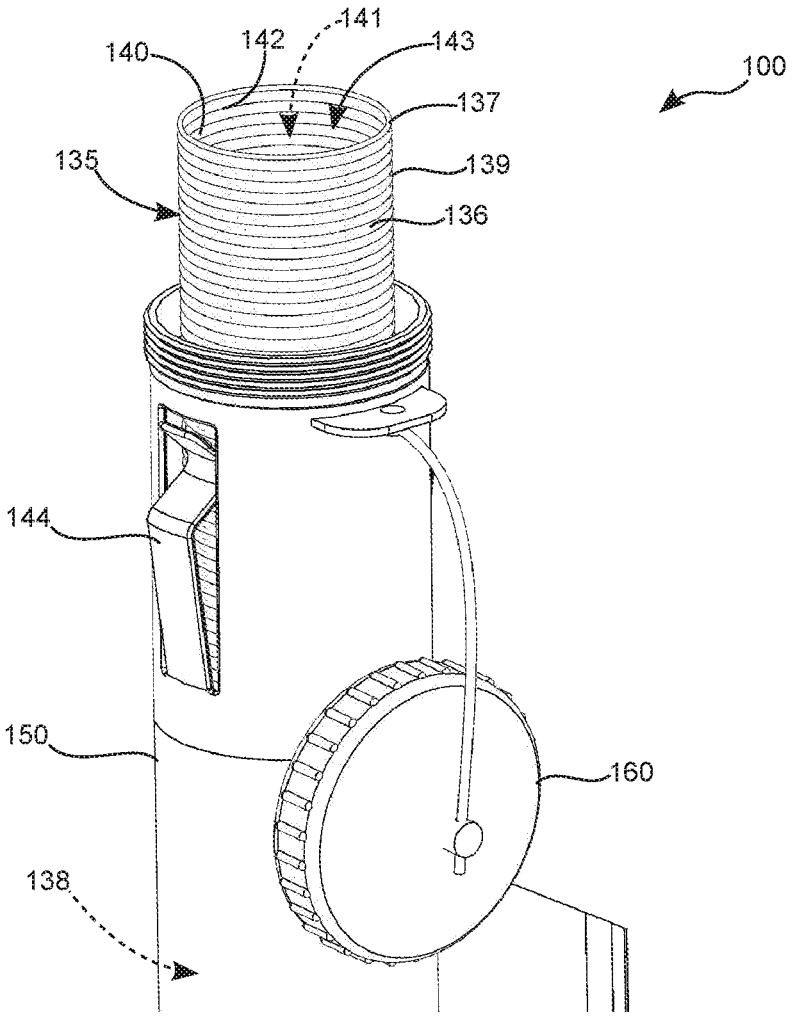
FIG. 3 is a perspective view illustrating the attachment portion and expandable hose member of the universal hose assembly for wet/dry vacuums according to an embodiment of the present invention of FIG. 1.

Referring now to FIG. 3, is a perspective view illustrating attachment portion 125 and expandable hose member 135 of universal hose assembly for wet/dry vacuums 100 according to an embodiment of the present invention of FIG. 1.

Expandable hose member 135 is attached to attachment portion 125 and extends a substantial portion of the length of elongated cylindrical wall 111 when in the contracted configuration, and is adapted to extend a substantial length beyond the length of elongated cylindrical wall 111 when in a plurality of the expanded configurations.

Elongated cylindrical wall 111 of expanding hose 110 further includes at least one aperture 143 therethrough in proximity to proximal end 112, and flexible tab 144 adjacent each aperture 143 is adapted to releasably contact exterior surface 139 of flexible cylindrical wall 136 of expandable hose member 135 to thereby retain expandable hose member 135 in a chosen configuration.

Figure 4A:
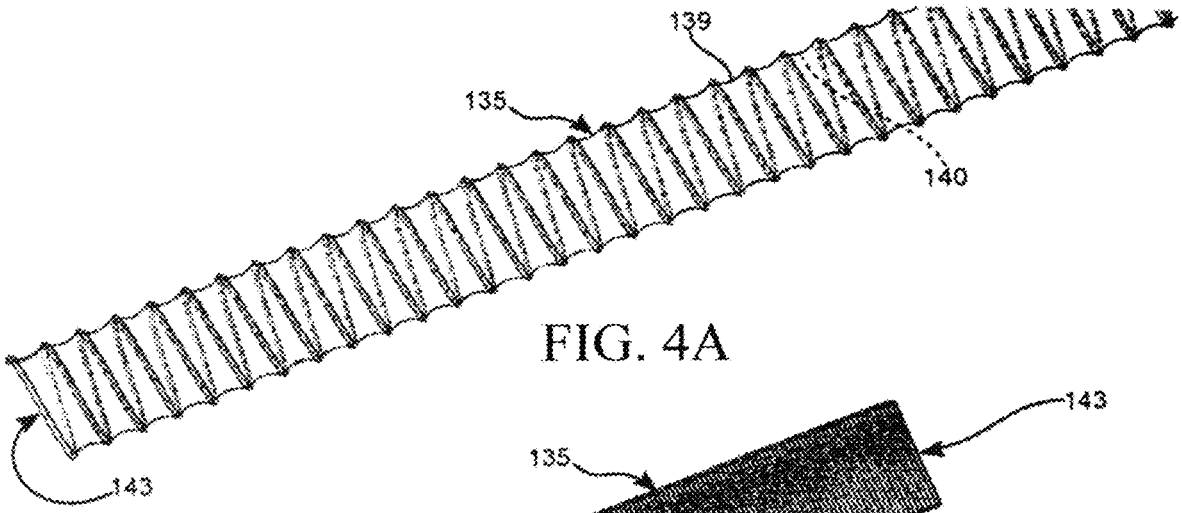
FIGS. 4A and 4B are a perspective view illustrating the expandable hose member of the universal hose assembly for wet/dry vacuums according to an embodiment of the present invention of FIG. 1.
Figure 4B:
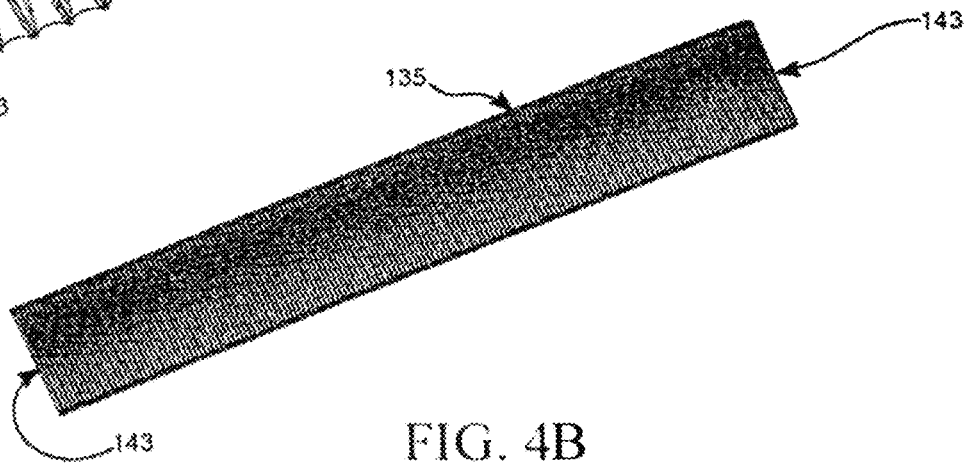

Referring now to FIGS. 4A and 4B, showing are showing is a perspective views illustrating expandable hose member 135 of universal hose assembly for wet/dry vacuums 100 according to an embodiment of the present invention of FIG. 1.

Expandable hose member 135 having flexible cylindrical wall 136 with proximal end 137, distal end 138, exterior surface 139, and interior surface 140 is located within elongated cylindrical wall 111. Flexible cylindrical wall 136 forms hollow interior volume 141 and helical wire 142 is attached to interior surface 140 of flexible cylindrical wall 136 from proximal end 137 to distal end 138 such that expandable hose member 135 is adapted to contract into a shorter, contracted, configuration or be pulled into a plurality of expanded configurations to thereby adjust the length of expandable hose member 135.

Figure 5A:
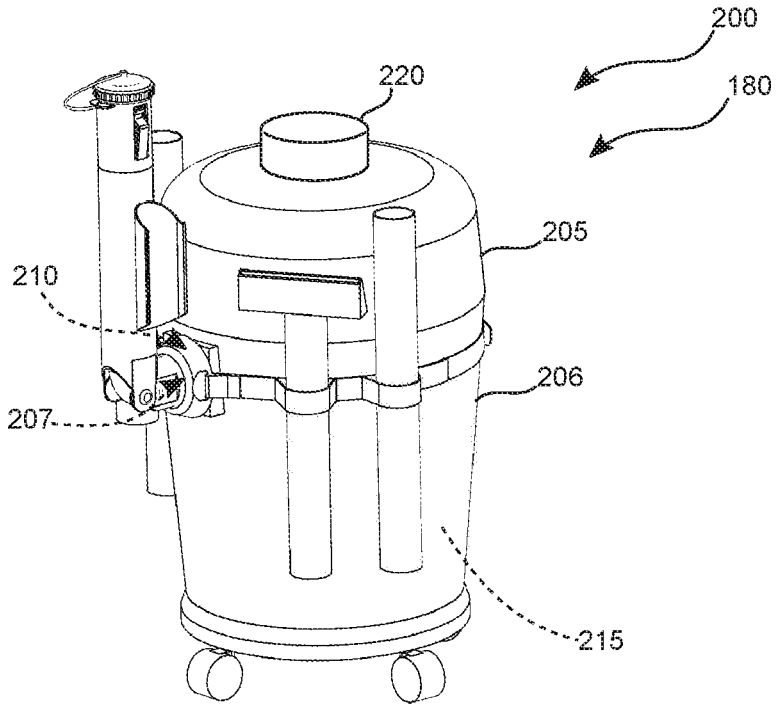
FIG. 5A is a perspective view illustrating an improved wet/dry vacuum system according to an embodiment of the present invention.

Referring now to FIG. 5A, is a perspective view illustrating improved wet/dry vacuum system 200 according to an embodiment of the present invention.

Improved wet/dry vacuum system 200 may comprise wet/dry vacuum 205 having outer wall 206 with aperture 207 that allows air to pass through, ring portion 210 attached to outer wall 206 that surrounds aperture 207, inner volume 215, motor 220 located within inner volume 215 adapted to draw air into aperture 207 and force air out of aperture 207, and universal hose assembly for wet/dry vacuums 100 comprising belt 105 having at least one attached loop 106 adapted to releasably hold accessories.

Belt 105 is adapted to adjustably attach around outer wall 206 of wet/dry vacuum 205. Expanding hose 110 is included that has elongated cylindrical wall 111 with proximal end 112, distal end 113, and length 114 extending from proximal end 112 to distal end 113 that forms hollow interior volume 115. Attachment portion 125 includes ring portion 126 adapted to connect with ring portion 210 of wet/dry vacuum 205. Connector portion 127 is rotatably connected to ring portion 126 and extends outwardly therefrom. Ring portion 126 and hose connector portion 127 form hollow cylindrical interior volume 128 and proximal end 112 of elongated cylindrical wall 111 is pivotally connected to hose connector portion 127 of attachment portion 125. Expandable hose member 135 having flexible cylindrical wall 136 includes proximal end 137, distal end 138, exterior surface 139, and interior surface 140 and flexible cylindrical wall 136 forms hollow interior volume 141.

Figure 5B:
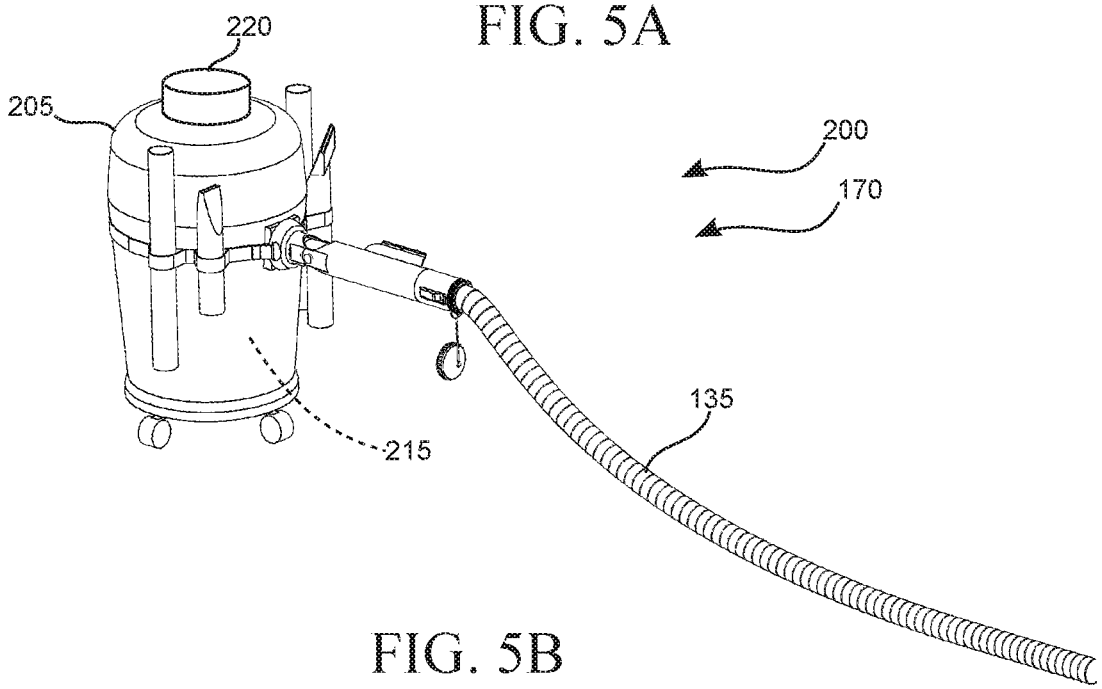
FIG. 5B is a perspective view illustrating an in use condition of the improved wet/dry vacuum system according to an embodiment of the present invention of FIG. 5A.

Referring now to FIG. 5B, is a perspective view illustrating an in use condition of improved wet/dry vacuum system 200 according to an embodiment of the present invention of FIG. 5A.

Helical wire 142 is attached to interior surface 140 of flexible cylindrical wall 136 from proximal end 137 to distal end 138 such that expandable hose member 135 is adapted to contract into a contracted configuration, or be pulled into a plurality of expanded configurations and adjust to a length. Expandable hose member 135 is attached to attachment portion 125 extending a substantial portion of the length of elongated cylindrical wall 111 when in the contracted configuration and is adapted to extend a substantial length beyond the length of elongated cylindrical wall 111 when in an expanded configuration.

Elongated cylindrical wall 111 of attachment portion 125 of expanding hose 110 is releasably connected to belt 105 and belt 105 is adapted to releasably and adjustably hold expanding hose 110 to ring portion 210 of wet/dry vacuum 205 such that air leaving and entering ring portion 210 of wet/dry vacuum 205 passes through expanding hose 110. Elongated cylindrical wall 111 of expanding hose 110 further includes at least one aperture 143 therethrough in proximity to proximal end 112, and flexible tab 144 adjacent each aperture 143 is adapted to releasably contact exterior surface 139 of flexible cylindrical wall 136 of expandable hose member 135 to thereby retain expandable hose member 135 in a chosen configuration.

At least one elongated attachment tube 150 is adapted to be releasably attached to distal end 138 of flexible cylindrical wall 136 of expanding hose 110. Elongated cylindrical wall 111 of expanding hose 110 further includes an attached clip 151 adapted to releasably hold one of elongated attachment tubes 150. Accessories 155 include a plurality of elongated attachment tubes 150 each adapted to be releasably attached to distal end 138 of flexible cylindrical wall 136 of expandable hose member 135. The plurality of elongated attachment tubes 150 are of different lengths and different shapes.

Expanding hose 110 further includes cap member 160 adapted to releasably connect to and cover distal end 113 of elongated cylindrical wall 111 of expanding hose 110 when expandable hose member 135 is in the contracted configuration. Gasket ring 165 is adapted to be placed in between ring portion 126 of attachment portion 125 of expanding hose 110 and ring portion 210 of wet/dry vacuum 205 to create a vacuum seal between the two.

Universal hose assembly for wet/dry vacuums 100 may be sold as a kit comprising the following parts: at least one belt 105; at least one attachment portion 125; at least one expandable hose member 135; at least one elongated attachment tube 150; at least one cap member 160; at least one gasket ring 165; and at least one set of user instructions. The kit has instructions such that functional relationships are detailed in relation to the structure of the invention (such that the invention can be used, maintained, or the like in a preferred manner). Universal hose assembly for wet/dry vacuums 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A universal hose assembly for wet/dry vacuums, comprising:

a belt including:
- at least one loop attached thereto adapted to releasably hold accessories thereto;
- wherein said belt is adapted to adjustably attach around an outer wall of a wet/dry vacuum;

an expanding hose including:
- an elongated cylindrical wall including:
  - a proximal end;
  - a distal end: and
  - a length extending from said proximal end to said distal end;
  - wherein said elongated cylindrical wall forms a hollow interior volume;
- an attachment portion including:
  - a ring portion;
    - wherein said ring portion is adapted to connect with a ring portion of said wet/dry vacuum; and
  - a connector portion;
    - wherein said connector portion is rotatably connected to said ring portion and extends outwardly therefrom;
  - wherein said ring portion and said hose connector portion form a hollow cylindrical interior volume;
- wherein said proximal end of said elongated cylindrical wall is pivotally connected to said connector portion of said attachment portion; and
- an expandable hose member including:
  - a flexible cylindrical wall including:
    - a proximal end;
    - a distal end;
    - an exterior surface; and
    - an interior surface;
    - wherein said flexible cylindrical wall forms a hollow interior volume; and
  - a helical wire;
    - wherein said helical wire is attached to said interior surface of said flexible cylindrical wall from said proximal end to said distal end, such that said expandable hose member is adapted to contract into a contracted configuration and be pulled into a plurality of expanded configurations to thereby adjust the length of said expandable hose member;
  - wherein said expandable hose member is attached to said attachment portion and extends a substantial portion of said length of said elongated cylindrical wall when in said contracted configuration, and is adapted to extend a substantial length beyond said length of said elongated cylindrical wall when in a plurality of said expanded configurations;

wherein said ring portion of said attachment portion of said expanding hose is releasably connected to said belt; and wherein said belt is adapted to releasably and adjustably hold said expanding hose to said ring portion of said wet/dry vacuum, such that air leaving and entering said ring portion of said wet/dry vacuum passes through said expanding hose.

2. The universal hose assembly for wet/dry vacuums of claim 1, wherein said elongated cylindrical wall of said expanding hose further includes at least one aperture therethrough in proximity to said proximal end thereof, and a flexible tab adjacent each said at least one aperture adapted to releasably contact said exterior surface of said flexible cylindrical wall of said expandable hose member to thereby retain said expandable hose member in a chosen configuration.

3. The universal hose assembly for wet/dry vacuums of claim 1, further comprising at least one elongated attachment tube adapted to be releasably attached to said distal end of said flexible cylindrical wall of said expandable hose.

4. The universal hose assembly for wet/dry vacuums of claim 3, wherein said elongated cylindrical wall of said expanding hose further includes a clip attached thereto adapted to releasably hold one of said least one elongated attachment tube thereto.

5. The universal hose assembly for wet/dry vacuums of claim 1, wherein said accessories includes a plurality of elongated attachment tubes each adapted to be releasably attached to said distal end of said flexible cylindrical wall of said expandable hose.

6. The universal hose assembly for wet/dry vacuums of claim 5, wherein said plurality of elongated attachment tubes have differing lengths.

7. The universal hose assembly for wet/dry vacuums of claim 5, wherein said plurality of elongated attachment tubes have differing shapes.

8. The universal hose assembly for wet/dry vacuums of claim 1, wherein said expanding hose further includes a cap member adapted to releasably connect to and cover said distal end of said elongated cylindrical wall of said expanding hose when said expandable hose member is in said contracted configuration.

9. The universal hose assembly for wet/dry vacuums of claim 1, further comprising a gasket ring adapted to be placed in between said ring portion of said attachment portion of said expanding hose and said ring portion of said wet/dry vacuum and create a vacuum seal there between.

10. An improved wet/dry vacuum system comprising:

a wet/dry vacuum including:

an outer wall including:

an aperture;

wherein said aperture allows air to pass therethrough;

a ring portion;

wherein said ring portion is attached to said outer wall and surrounds said aperture;

an inner volume; and a motor;

wherein said motor is located within said inner volume and adapted to draw air into said aperture and force air out of said aperture; and a universal hose assembly comprising:

a belt including:

at least one loop attached thereto adapted to releasably hold accessories thereto;

wherein said belt is adapted to adjustably attach around said outer wall of said wet/dry vacuum;

an expanding hose including:

an elongated cylindrical wall including:

a proximal end;

a distal end: and a length extending from said proximal end to said distal end;

wherein said elongated cylindrical wall forms a hollow interior volume;

an attachment portion including:

a ring portion;

wherein said ring portion is adapted to connect with said ring portion of said wet/dry vacuum; and a connector portion;

wherein said connector portion is rotatably connected to said ring portion and extends outwardly therefrom;

wherein said ring portion and said hose connector portion form a hollow cylindrical interior volume;

wherein said proximal end of said elongated cylindrical wall is pivotally connected to said connector portion of said attachment portion; and an expandable hose member including:

a flexible cylindrical wall including:

a proximal end;

a distal end;

an exterior surface; and an interior surface;

wherein said flexible cylindrical wall forms a hollow interior volume; and a helical wire;

wherein said helical wire is attached to said interior surface of said flexible cylindrical wall from said proximal end to said distal end, such that said expandable hose member is adapted to contract into a contracted configuration and be pulled into a plurality of expanded configurations to thereby adjust the length of said expandable hose member;

wherein said expandable hose member is attached to said attachment portion and extends a substantial portion of said length of said elongated cylindrical wall when in said contracted configuration, and is adapted to extend a substantial length beyond said length of said elongated cylindrical wall when in a plurality of said expanded configurations;

wherein said ring portion of said attachment portion of said expanding hose is releasably connected to said belt; and wherein said belt is adapted to releasably and adjustably hold said expanding hose to said ring portion of said wet/dry vacuum, such that air leaving and entering said ring portion of said wet/dry vacuum passes through said expanding hose.

11. The improved wet/dry vacuum system of claim 10, wherein said elongated cylindrical wall of said expanding hose further includes at least one aperture therethrough in proximity to said proximal end thereof, and a flexible tab adjacent each said at least one aperture adapted to releasably contact said exterior surface of said flexible cylindrical wall of said expandable hose member to thereby retain said expandable hose member in a chosen configuration.

12. The improved wet/dry vacuum system of claim 10, further comprising at least one elongated attachment tube adapted to be releasably attached to said distal end of said flexible cylindrical wall of said expandable hose.

13. The improved wet/dry vacuum system of claim 12, wherein said elongated cylindrical wall of said expanding hose further includes a clip attached thereto adapted to releasably hold one of said least one elongated attachment tube thereto.

14. The improved wet/dry vacuum system of claim 10, wherein said accessories includes a plurality of elongated attachment tubes each adapted to be releasably attached to said distal end of said flexible cylindrical wall of said expandable hose.

15. The improved wet/dry vacuum system of claim 14, wherein said plurality of elongated attachment tubes have differing lengths.

16. The improved wet/dry vacuum system of claim 14, wherein said plurality of elongated attachment tubes have differing shapes.

17. The improved wet/dry vacuum system of claim 10, wherein said expanding hose further includes a cap member adapted to releasably connect to and cover said distal end of said elongated cylindrical wall of said expanding hose when said expandable hose member is in said contracted configuration.

18. The improved wet/dry vacuum system of claim 10, further comprising a gasket ring adapted to be placed in between said ring portion of said attachment portion of said expanding hose and said ring portion of said wet/dry vacuum and create a vacuum seal there between.

* * * * *